US006576411B1

(12) United States Patent
Irving et al.

(10) Patent No.: US 6,576,411 B1
(45) **Date of Patent: *Jun. 10, 2003**

(54) METHOD OF PASSIVATING A SILVER DONOR WITH A DYE AND PHOTOTHERMOGRAPHIC SYSTEMS MADE THEREBY

(75) Inventors: Mark E. Irving, Rochester, NY (US); Gregg P. Bryant, Rochester, NY (US); JoAnn D. Hanna, Rochester, NY (US); Mark R. Mis, Rochester, NY (US); Nancy B. Liebert, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/990,641

(22) Filed: Nov. 21, 2001

(51) Int. Cl.[7] ..... G03C 1/498; G03C 1/815; G03C 1/46

(52) U.S. Cl. ..... 430/503; 430/502; 430/512; 430/517; 430/543; 430/559; 430/566; 430/570; 430/607; 430/613; 430/620; 430/944; 430/964

(58) Field of Search ..... 430/505, 559, 430/619, 566, 620, 543, 502, 512, 517, 607, 613, 944, 964, 570, 503

(56) References Cited

U.S. PATENT DOCUMENTS

| | | | | |
|---|---|---|---|---|
| 4,665,012 A | | 5/1987 | Sugimoto et al. | |
| 6,040,131 A | * | 3/2000 | Eshelman et al. | 430/619 |
| 6,355,408 B1 | | 3/2002 | Whitcomb et al. | |

* cited by examiner

*Primary Examiner*—Thorl Chea
(74) *Attorney, Agent, or Firm*—Chris P. Konkol

(57) ABSTRACT

The invention is directed to a color photothermographic film in which particles comprising an organic silver salt is treated with a dye that functions as a passivating agent. In particular, the present invention involves passivating the organic silver salts with a dye that blocks the surface of the organic silver salt or ligand, resulting in a reduction of speed loss. The invention is also directed to a method of making a photothermographic element to improve raw stock keeping.

44 Claims, No Drawings

METHOD OF PASSIVATING A SILVER DONOR WITH A DYE AND PHOTOTHERMOGRAPHIC SYSTEMS MADE THEREBY

FIELD OF THE INVENTION

This invention relates to photothermographic capture films. In particular, this invention relates to the use of a dye as a passivating agent that absorbs onto the surface of organic silver salts to improve raw stock speed and, hence, the performance of photothermographic systems.

BACKGROUND OF THE INVENTION

Imaging elements that can be processed, after imagewise exposure, simply by heating the element are referred to as photothermographic elements. Preferably, photothermographic films do not require any processing solutions and instead contain within them all the chemistry required for development of a photographic image. These film chemistries are designed so that at room temperature they are inactive, but at elevated temperatures (greater than 120° C.) the film chemistries become functionally active.

A problem in designing such photothermographic films is that it has been found that certain properties may degrade over time, including speed. It is desirable that photothermographic elements be capable of maintaining its imaging properties, including speed, during storage periods. This is referred to as Raw Stock Keeping ("RSK"). Ideally, film should be storage stable, under normal conditions, preferably for at least 12 months, more preferably for at least 24 months. If a film speed loses are too much during storage, poor or unacceptable image formation can occur.

Raw stock keeping is especially a problem for color photothermographic films (color "PTG films"), compared to conventional films or even black & white PTG films. This is because at least three color records are required, and all the components needed for development and image formation must be incorporated into the imaging element, in intimate proximity, in potentially reactive association, prior to development. Thus, there are a greater number of potentially reactive components that can prematurely react during storage. Furthermore, color photothermographic film involves new and unfamiliar chemistries and systems, in which the performance of new and complex combinations of components is unpredictable and subject to undesirable interactions, incompatibilities, or side reactions. The imaging chemistry must be designed to provide fast, high quality latent image formation during image capture, but must not interact prematurely. Similarly, the film must be capable of fast development and high quality image formation during thermal processing, but the same components must not prematurely interact before the processing step.

There remains a need for a photothermographic film that does not exhibit any significant loss of speed during raw stock keeping.

PROBLEM SOLVED BY THE INVENTION

In photothermographic (PTG) film, silver-halide emulsions are spectrally sensitized to make them sensitive to various wavelengths of light in the visible spectrum. This spectral sensitization is accomplished by adsorbing sensitizing dye to the emulsions. However, it has been observed that the organic silver salts in the system also have a large propensity to adsorb sensitizing dye, such that when the organic silver salts are in contact with a dyed silver halide emulsion, they can remove dye from the silver halide emulsion, resulting in a loss of photographic speed. The ability of the organic silver salts to adsorb dye is related not only to the adsorption strength of the materials for sensitizing dye, but also to the high surface area for adsorption of the particles, related to their small grain size. There are several opportunities for the organic silver salts to contact the silver halide emulsions and transfer sensitizing dye within pre-coating melts, during coating (when dual melted), or in the film during raw stock keeping.

SUMMARY OF THE INVENTION

It has been found that speed loss on raw stock keeping in color photothermographic film can be prevented or minimized by the use of a dye as a passivating agent to make organic silver salts or ligands less detrimental or "friendlier" toward silver halide emulsions. In particular, the present invention involves passivating the organic silver salts with a dye adsorbate that blocks the surface of the organic silver salt or ligand, resulting in a significant reduction in sensitizing dye loss from the silver halide emulsion and concomitant reduction of speed loss in the ultimate coated layer, including both "fresh speed loss" (speed loss present prior to storage) and speed loss after storage (the latter characterized as "raw stock keeping").

The invention is also directed to a method of making a photothermographic element to prevent speed loss and to improve raw stock keeping.

Definitions of terms, as used herein, include the following:

In the descriptions of the photothermographic materials of the present invention, "a" or "an" component refers to "at least one" of that component. For example, the silver salts described herein can be used individually or in mixtures.

Heating in a substantially water-free condition as used herein, means heating at a temperature of from about 50° to about 250° C. with little more than ambient water vapor present. The term "substantially water-free condition" means that the reaction system is approximately in equilibrium with water in the air, and water for inducing or promoting the reaction is not particularly or positively supplied from the exterior to the material. Such a condition is described in T. H. James, *The Theory of the Photographic Process*, Fourth Edition, Macmillan 1977, p 374.

"Color photothermographic material(s)" means a construction comprising at least three photothermographic emulsion layers a photothermographic set of layers of different "hue" and any supports, topcoat layers, blocking layers, antihalation layers, subbing or priming layers, and the like. The term "hue" includes non-visible "colors" capable of providing image formation analogous to visible colors. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Emulsion layer," "imaging layer," or "photothermographic emulsion layer," means a layer of a photothermographic material that contains the photosensitive silver halide (when used) and non-photosensitive source of reducible silver ions.

"Non-photosensitive" means not intentionally light sensitive.

The term "organic silver salt" is herein meant to include salts as well as ligands comprising two ionized species. The silver salts used to make the core-shell particles are preferably comprised of silver salts of organic coordinating ligands. Many examples of such organic coordinating ligands are described below.

The terms "blocked developer" and "developer precursor" are the same and are meant to include developer precursors, blocked developer, hindered developers, developers with blocking and/or timing groups, wherein the term "developer" is used to indicate a reducing substance for silver ion.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

DETAILED DESCRIPTION OF THE INVENTION

The present invention is directed to a photothermographic element comprising at least three imaging layers comprising a developer or developer precursor, a coupler in the case of color or monochrome imaging elements, silver halide, and at least one organic silver compound. At least one of the organic silver compounds is a silver donor, which typically is present at levels in the range of 5 to 3,000 g/mol of imaging silver. The dividing line of whether an organic silver compound functions as a silver donor (exclusively or partly) is sometimes unclear, and for present purposes silver organic compounds are meant to include both silver donors and compounds which have various functions in addition to, or instead of, that of a silver donor.

As indicated above, silver-halide emulsions for use in photothermographic imaging elements are spectrally sensitized to make them sensitive to various wavelengths of light in the visible spectrum, typically red, blue, and green. The present invention involves passivating the organic silver compound with a dye adsorbate that blocks the surface of the organic silver compound, resulting in a significant reduction in sensitizing dye loss from the silver-halide emulsion and concomitant reduction of speed loss in the ultimately coated imaging layer, including both fresh speed loss and speed loss after raw stock keeping.

In particular, the present invention is directed to a color photothermographic imaging element comprising a red light-sensitive silver halide layer unit, a green light-sensitive silver halide layer unit, and a blue light-sensitive silver halide layer unit, each layer unit further comprising a light sensitive silver halide emulsion, a binder (preferably a hydrophilic binder), and one or more essentially non-light sensitive organic silver compounds, at least one of which functions as an oxidizing agent for the purpose of donating silver during dry thermal development, and a developing agent (preferably a blocked developing agent). A feature of the invention is that at least one imaging layer in the imaging element, preferably all the imaging layers, comprises at least one (including one or more) organic silver compound that has been treated with at least one (including one or more) dye (as a passivating agent) in a total amount that is capable of providing (ex situ) an average coverage of at least 5%, preferably 25 to 200%, more preferably 50 to 120%, of the available surface area of the particles of the organic silver compound. According to the invention, the average coverage of the available surface area of the same organic silver compound with the dye, if not 100 percent, is substantially more than would have occurred had the silver organic compound particles and the silver-halide crystals in the imaging layer been mixed before treatment of the organic silver compound with the dye passivating agent.

By the term "ex situ" is meant that the above-mentioned percentages can be determined by the Langmuir adsorption test starting with only the components of interest (namely the organic silver compound treated with the passivating agent and the silver-halide emulsion used in the imaging element) before the addition of, or the presence of, the other components used in the imaging element. In contrast, the term "in situ" in the present application refers to an analysis starting with the actual imaging element and involving the separation and analysis of the components of relevance.

In the ex situ case, then, the amount of dye passivating agent to be used in an imaging layer to provide the necessary coverage of dye passivating agent on the organic silver compound can be determined by standard analytical techniques and measurements, by taking a sample of fresh and unmixed particles of the organic silver compound and testing how much of the dye passivating agent is necessary to provide at least 5% coverage of the available surface area and that is the amount used to treat the organic silver compound according to the present invention. Similarly, the coverage on the particles of the organic silver compound if the organic silver compound has been previously mixed with the silver-halide crystals before passivation can be determined by starting with a mixture of the particles of the organic silver compound and the silver halide.

Preferably, ex situ, the ratio of (passivating-agent average coverage)/(available surface area) for the treated organic silver compound compared to the ratio for the mixed organic silver compound and silver halide is greater than 1.0, preferably greater than 1.5, more preferably greater than 2.0.

In one embodiment of the invention, at least one imaging layer comprises particles of an organic silver compound on which one or more dye passivating agents provides an average coverage (in situ) of at least 5%, preferably 25 to 200%, more preferably 50 to 120%, of the available surface area of the organic silver compound particles, and the passivating agent is substantially absent from, or provides an average coverage (in situ), of less than 5% of the available surface area of the silver halide crystals in the imaging element, as can be determined by standard conventional analytical techniques. In another embodiment, at least one imaging layer comprises particles of an organic silver compound on which one or more dye passivating agents provides an average coverage (in situ) of at least 10% of the available surface area of the organic silver salt particles, and the passivating agent is substantially absent from, or provides an average coverage of less than 10% of the available surface area of the silver halide crystals in the imaging element, as can be determined by standard conventional analytical techniques.

In one particular embodiment, the average amount of the passivating agent that has been used to treat the organic silver compound is at least 0.5 mmole of passivating agent/mole of the organic silver compound. However, the actual amount may vary as the surface-to-volume ratio of the organic silver compound changes.

To determine the percent coverage (which is an average measure), the moles of dye passivating agent necessary for saturation must be determined according to experimental procedure provided below, that is the Langmuir adsorption isotherm test (ref. T. H. James, The Theory of the Photographic Process, $4^{th}$ edition, pg 236 and following for discussion of dye adsorption. The percent coverage of the passivating agent is then calculated based on the following formula:

Percent coverage=100×(moles of passivating agent used)/(moles of passivating agent required for saturation of the available surface area of the organic silver particles)

Saturation can usually be determined for dyes by determining when light absorption due to the aggregate adsorption no longer increases and the light absorption due to the monomer adsorption does increase when more compound in added. Preferably, however, saturation can be determined by measuring when additional increments of added dye passivating agents no longer adsorb onto the surface but remain in solution. This is accomplished by centrifuging the dye-passivated particles and analyzing the supernatant concentration for passivating agent.

Passivating materials can include a wide variety of dye compounds that have in common the ability to adsorb onto particles of an organic silver compound. The dye passivating agents should have the property of effectively adsorbing to metallic silver and salts thereof.

In one embodiment of the invention, the dye passivating agent is a dye in the visible or non-visible spectrum. For example, the dye passivating agent can be a dye compound that is a spectral sensitizing dye, meaning having the property of a spectral sensitizing dye if adsorbed onto a silver halide crystal. The color photothermographic element may comprise one imaging layer in which the dye passivating agent is a spectral sensitizing dye and another imaging layer in which the passivating agent is a UV dye, for example. Preferably, however, the dye passivating agent in one or more imaging layers is a spectral sensitizing dye that has not been used to treat the silver halide crystal used in that layer. Although there is an advantage with the same compound used as a spectral sensitizing dye and a dye passivating agent, since there is less risk of an adverse affect upon any dye passivating agent reaching the silver halide crystals, this may be disadvantageous for other reasons.

In another embodiment, the dye passivating agent is an infrared or ultraviolet filter dye. An advantage here is that there is less risk of an adverse affect upon any passivating agent reaching the silver halide crystals, and the passivating agent can provide an additional beneficial function.

Various combinations of passivating agents in different layers are envisioned as an option. Non-dye passivating agents can be used in combination with dye passivating agents. For example, non-dye passivating materials can include a wide variety of compounds that have in common the ability to adsorb onto particles of an organic silver compound. The passivating agents should have the property of effectively adsorbing to metallic silver and salts thereof. Typically, organic compounds having a nitrogen or sulfur group or other groups will tend to enhance adsorption of the passivating agent onto metallic silver and salts thereof. An example of a compound having a nitrogen group is tetraazaindene and derivatives thereof. Examples of other suitable compounds include, but is not limited to, 3-isothiuronium-propanesulfonate, 1-(3-acetamidophenyl)-5-mercaptotetrazole, 2-mercaptobenzothiazole, 3-(2-methylsulfamoylethyl)-benzothiazolium tetrafluoroborate, 3-methyl-1,3-benzothiazolium iodide, 4-hydroxy-6-methyl-1,3,3a,7-tetrazaindene sodium salt, 5-bromo-4-hydroxy-6-methyl-1,3,3a,7-tetrazaindene, and 2-methylthio-4-hydroxy-6-methyl-1,3,3a,7-tetraazaindene.

Thus, the color photothermographic element can comprise a plurality of imaging layers with passivated organic silver salts in which the passivating agent is different in at least two different imaging layers. For example, the passivating agent in one imaging layer is a passivating spectral sensitizing dye and the passivating agent in a second imaging layer is a UV dye. As another example, the passivating agent in one imaging layer is a UV dye and the passivating agent in another imaging layer can be a relatively low cost material such as tetraazindene.

Thus, another embodiment of the present invention comprises a color photothermographic element comprising a red light-sensitive silver halide layer unit, a green light-sensitive silver halide layer unit, and a blue light-sensitive silver-halide layer unit, each layer unit further comprising a light-sensitive silver-halide emulsion, a binder, and one or more essentially non-light sensitive organic silver compounds, at least one of which functions as an oxidizing agent for the purpose of donating silver during dry thermal development, and a developing agent. A feature of the invention is that at least one imaging layer comprises an organic silver compound which has been treated with a dye in a total amount that is capable of providing (ex situ) an average coverage of at least 5%, preferably 25 to 200%, more preferably 50 to 120%, of the available surface area of the organic silver particles, and wherein the average coverage of the available surface area of the same organic silver particles with said dye is substantially more than would have occurred had the organic silver particles and the organic silver halide particles been mixed before treatment of the organic silver with the dye. Preferably, the ratio of (dye average coverage)/(available surface area) for the organic silver compared to the ratio of the previously mixed organic silver particles is greater than 1, preferably greater than 1.5, more preferably greater than 2.0.

Preferably, the dye can absorb light in the visible and/or non-visible spectrum but does not significantly change the integrated spectral absorption of the silver halide. Preferably any change in absorption is not more than 15 percent, more preferably, not more than 10 percent. As indicated above, the dye can be selected from the group consisting of filter dyes, trimmer dyes, AHU dyes, spectral sensitizing dyes, spectral desensitizing dyes, UV dyes, and IR dyes useful in a photographic or photothermographic system. The dyes can be selected from various fields, including but not limited to the photographic field, the inkjet field, as well as dyes used in the clothing or paint industry. Thus, commercially useful dyes and derivatives or equivalents thereof, now or in the future, can be used in the present invention as passivating agents, including dyes disclosed in patents. Preferred classes of dyes include, merely by example, cyanines, merocyanines, complex cyanines and merocyanines, oxonols, hemioxonols, styryls, merostyryls, streptocyanines, hemicyanines, azo dyes, azomethines, styryl and butadienyl dyes, metrostyryl, isoxazole, aminiohemi oxonol, cyanomethyl sulfone-derived merocyanines, hemioxonols, pyrazolones, and arylidenes. Preferably, the dyes are selected from the compounds disclosed in Sections V, VI, and VIII of the *Research Disclosure*. Potential candidates for compounds that are not dyes and that meet the requirements of the passivating agents according to the present invention include, but are not limited to, antifoggants and stabilizers and other photographically useful compounds that such as referred to in Section VII of the *Research Disclosure*.

In another embodiment of the invention, in which the passivating agent (in one or more color unit layer) serves a dual function, of both a passivating agent and a filter agent.

Photothermographic elements of the present invention are disclosed in *Research Disclosure* No. 17029 (1978). Type B elements are particularly relevant to the present invention, since the present invention, in common with Type B elements, contains in reactive association a photosensitive silver halide, a reducing agent or developer, optionally an activator, a coating vehicle or binder, and a salt or complex of an organic compound with silver ion. In these systems, this organic complex (referred to as the silver donor) is reduced during development to yield silver metal. References describing such imaging elements include, for example, U.S. Pat. Nos. 3,457,075; 4,459,350, 4,264,725 and 4,741,992. In the type B photothermographic material, it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The present photothermographic element comprises an oxidation-reduction image forming combination that contains an organic silver compound oxidizing agent. The organic silver compound is a silver salt which is comparatively stable to light, but aids in the formation of a silver image when heated to 80° C. or higher in the presence of an exposed photocatalyst (i.e., the photosensitive silver halide) and a reducing agent.

As mentioned above, more than one organic silver compound may be present in an imaging layer. There may be more than one organic silver salt in an imaging layer, either in the form of a mixture of particles, as disclosed in more detail in commonly assigned copending Ser. No. 09/863,599, hereby incorporated by reference in its entirety, or in the form of core/shell particles, formed by sequential addition of different organic silver salts, or mixtures of organic silver salts, during particle growth, as disclosed in more detail in commonly assigned copending application Ser. Nos. 09/991,051 and 09/990,720, hereby incorporated by reference in their entirety.

In the present invention, preferably at least one organic silver compound is a silver salt of a nitrogen acid (imine) group, which can optionally be part of the ring structure of a heterocylic compound. Aliphatic and aromatic carboxylic acids such as silver behenate or silver benzoate, in which the silver is associated with the carboxylic acid moiety, are specifically excluded as the organic silver donor compound. Compounds that have both a nitrogen acid moiety and carboxylic acid moiety are included as donors of this invention only insofar as the silver ion is associated with the nitrogen acid rather than the carboxylic acid group. The donor can also contain a mercapto residue.

Preferably, a silver salt of a compound containing an imino group can be used, and the compound contains a heterocyclic nucleus. Typical preferred heterocyclic nuclei include triazole, oxazole, thiazole, thiazoline, imidazoline, imidazole, diazole, pyridine and triazine.

The organic silver salt may also be the derivative of a tetrazole. Specific examples include but are not limited to 1H-tetrazole, 5-ethyl-1H-tetrazole, 5-amino-1H-tetrazole, 5-4'methoxyphenyl-1H-tetrazole, and 5-4'carboxyphenyl-1H-tetrazole.

The organic silver salt may also be a derivative of an imidazole. Specific examples include but are not limited to benzimidazole, 5-methyl-benzimidazole, imidazole, 2-methyl-benzimidazole, and 2-methyl-5-nitro-benzimidazole.

The organic silver salt may also be a derivative of a pyrazole. Specific examples include but are not limited to pyrazole, 3,4-methyl-pyrazole, and 3-phenyl-pyrazole.

The organic silver salt may also be a derivative of a triazole. Specific examples include but are not limited to benzotriazole, 1H-1,2,4-trazole, 3-amino-1,2,4 triazole, 3-amino-5-benzylmercapto-1,2,4-triazole, 5,6-dimethyl benzotriazole, 5-chloro benzotriazole, and 4-nitro-6-chloro-benzotriazole.

Other silver salts of nitrogen acids may also be used. Examples would include but not be limited to o-benzoic sulfimide, 4-hydroxy-6-methyl-1,3,3A,7-tetraazaindene, 4-hydroxy-6-methyl-1,2,3,3A,7-pentaazaindene, urazole, and 4-hydroxy-5-bromo-6-methyl-1,2,3,3A,7-pentaazaindene.

Most preferred examples of the organic silver donor compounds include the silver salts of benzotriazole, triazole, and derivatives thereof, as mentioned above and also described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, a silver salt of 1H-tetrazole as described in U.S. Pat. No. 4,220,709.

Silver salt complexes may be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

The imaging layers may also include an organic silver salt that acts as thermal fog inhibitor which is relatively less oxidatively reactive (hereafter referred to as a less-reactive organic silver salt. Such salts include silver salts of thiol or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 2-mercaptobenzimidazole, a silver salt of 2-mercapto-5-aminothiadiazole, a silver salt of 5-carboxylic-1-methyl-2-phenyl-4-thiopyridine, a silver salt of mercaptotriazine, a silver salt of 2-mercaptobenzoxazole.

Less-reactive organic silver salts may be a derivative of a thionamide. Specific examples would include but not be limited to the silver salts of 6-chloro-2-mercapto benzothiazole, 2-mercapto-thiazole, naptho(1,2-d)thiazole-2(1H)-thione,4-methyl-4-thiazoline-2-thione, 2-thiazolidinethione, 4,5-dimethyl-4-thiazoline-2-thione, 4-methyl-5-carboxy-4-thiazoline-2-thione, and 3-(2-carboxyethyl)-4-methyl-4-thiazoline-2-thione.

Preferably, less-reactive organic silver salts are a derivative of a mercapto-triazole. Specific examples would include, but not be limited to, a silver salt of 3-mercapto-4-phenyl-1,2,4 triazol and a silver salt of 3-mercapto-1,2,4-triazole.

Most preferably, less-reactive organic salts is a derivative of a mercapto-tetrazole. In one preferred embodiment, a mercapto tetrazole compound useful in the present invention is represented by the following structure:

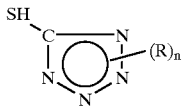

wherein n is 0 or 1, and R is independently selected from the group consisting of substituted or unsubstituted alkyl, aralkyl, or aryl. Substituents include, but are not limited to, C1 to C6 alkyl, nitro, halogen, and the like, which substituents do not adversely affect the thermal fog inhibiting effect of the silver salt. Preferably, n is 1 and R is an alkyl having 1 to 16 carbon atoms or a substituted or unsubstituted phenyl group. Specific examples include but are not limited to silver salts of 1-phenyl-5-mercapto-tetrazole, 1-(3-acetamido)-5-mercapto-tetrazole, or 1-[3-(2-sulfo)benzamidophenyl]-5-mercapto-tetrazole.

In one embodiment of the invention, the imaging element comprises a first organic silver salt that is a benzotriazole or derivative thereof and a second organic silver salt that is a mercapto-functional compound, preferably a mercapto-heterocyclic compound. The second organic silver salt, at levels in the range of 5 to 3,000 g/mol of imaging silver, can effectively inhibit fog during thermal processing of chromogenic photothermographic films comprising a silver donor.

A particularly preferred thermal fog inhibitor is 1-phenyl-5-mercapto-tetrazole (PMT). In contrast, if such levels of PMT were incorporated in a film system intended to be processed conventionally, the film would show unacceptable speed and suppression of image formation. Surprisingly, in a photothermographic system, however, the thermal fog inhibitor succeeds in effectively suppressing the formation of Dmin with little or no penalty in imaging speed or Dmax formation. In many instances, enhancement of Dmax can even be shown by the use of the thermal fog inhibitor, an effect completely unexpected in comparison to the conventional system.

The silver donors can also comprise assymmetrical silver donors or dimers such as disclosed in commonly assigned U.S. Pat. No. 5,466,804 to Whitcomb et al.

Silver salts complexes may be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver compound are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

The silver donors passivated according to this invention can be core/shell type of donors as disclosed in commonly assigned, copending application Ser. Nos. 09/991,051 and 09/990,720 and 60/201,858, hereby incorporated by reference. Core/shell donors are particles that comprise a mixture of at least two non-photosensitive organic silver salts, which particles comprise at least one shell comprising a first organic silver salt covering a core or central portion comprising a second organic silver salt. In one embodiment, the organic silver salt in the shell has a higher pKsp, relative to the organic silver salt in the core or central portion. However, a distinct core/shell boundary may not be indicated in the particle due to continuous concentration changes of the materials used to make the particle, although the concentrations of the different organic silver salts in the particle may be such as to be tantamount to a core/shell type of particle.

The fact that the first organic silver salt in an outside shell has a relatively high pKsp means it binds more strongly with silver, in turn meaning that it is less soluble and less reactive and less available (prematurely) for physical development, than would be a second organic silver salt. However, during heat development, the second organic salt in the core or inner shell becomes readily available. Thus, the core/shell structure cooperates with temperature transition during development. The oxidatively more reactive organic silver salt, with the lower pKsp becomes active during heating, while prior to heat development, the less oxidatively less reactive silver salt, with a relatively high pKsp dominates or effectively blocks or limits the reactivity of the material in the core. In other words, the first organic silver salt functions to protect from, and decrease the extent of, the premature reaction of the second organic silver salt with any other component in the imaging layer.

For example, in the special case of a core/shell particle having equal amounts of the two selected organic silver salts, it has been surprisingly found that the core/shell silver organic donor (having the lower pKsp) acts nearly the same (during heat development) as if the different organic silver salts were in separate populations of particles, notwithstanding that the core/shell particles do perform different than separate particles in terms of raw stock keeping, and that it might have been expected that the higher pKsp organic silver salt in the shell might hinder or otherwise adversely affect the reactive functioning on of the lower pKsp organic silver salt during development. This shows that the core/shell particles can provide greater stability and a lower Dmin, without being offset by loss of reactivity or speed during development. In fact, core/shell particles can provide essentially or approximately equal sensitometry to a control when the total mole quantities of each of two organic silver salts are the same. Without wishing to be bound by theory, it may be that the core/shell structure of the particles and their properties vary between the low temperature and high temperature exposures of the photothermographic element. With higher temperature, the organic salts may form a mixture or coalesce, eliminating any diffusion barrier to the low pKsp material in the core. Another advantage of core/shell organic silver donors are that they can provide better flow properties and lower viscosity compared to a mixture of separate populations of the organic silver salts. There is also the manufacturing advantage of making and using a single donor material as compared to making separate emulsions.

Such core/shell particles of organic silver donor can be made by a method comprising, first, preparing a dispersion of a second non-photosensitive organic silver salt from silver ions and a second silver organic coordinating ligand, and, second, preparing a first non-photosensitive organic silver salt as a shell on the second non-photosensitive silver salt by adding, in the presence of silver ions, a first silver organic coordinating ligand to the dispersion of the second non-photosensitive silver salt, the first and second silver organic coordinating ligands being different. In one embodiment, the first organic silver ligand in the shell exhibits a pKsp difference of at least 0.5, preferably at least 1.0, more preferably at least 2.0 greater than the pKsp of the second organic silver ligand.

It is particularly beneficial to passivate such core/shell particles according to the present invention, in order to obtain both the advantages of such core/shell particles mentioned above, while minimizing speed loss on raw stock keeping in photothermographic film and rendering the organic silver salts or ligands less detrimental toward the silver halide emulsion. Thus, in one embodiment of the invention, a core/shell donor is passivated to reduce incubation fog and/or incubation speed loss.

Another aspect of the present invention relates to a method of making a color photothermographic element comprising silver halide and an organic silver compound. Typically, a silver-halide emulsion is prepared separately from a melt of the other ingredients of the imaging layer, which includes a binder such as gelatin and the organic silver compound or compounds. In one embodiment of a method of making a color photothermographic imaging element according to the present invention, a silver-halide emulsion is mixed with a melt comprising a hydrophilic binder and an organic silver compound to produce an imaging-layer composition, wherein prior to said mixing, the silver-halide emulsion has been spectrally sensitized and the organic silver compound has been treated with at least one dye as a passivativing agent (that is, one or more dyes). This imaging-layer composition is then coated onto a substrate comprising a photothermographic film material. Thus, the silver halide is spectrally sensitized and the organic silver compound is passivated with dye before mixing in order to avoid intimately mixing a spectrally sensitized silver halide with an organic silver compound having clean surfaces. Subsequently, the emulsion and the melt are then mixed prior to coating the imaging-layer composition onto a supported substrate, including any underlayers, comprising the film. The method encompasses the situation where the dye passivating compound and the spectral sensitizing dye is the same compound.

In contrast, it has been observed that when non-passivated organic silver compounds are melted with silver halide and coated, there can be fresh speed loss. This may be due to a larger driving force of a clean surface on the organic silver compound to accept spectral sensitizing dye from the spectrally sensitized silver halide salt. Even when organic silver compounds are coated separately from the silver halide emulsion, there can also be fresh and raw stock keeping speed loss. This is believed due to a portion of the spectral sensitizing dye being diverted from the silver halide grains to the organic silver particles within the coated film environment.

Adding excess spectral sensitizing dye to the silver-halide emulsion prior to mixture with the organic silver compound is not the best solution, because any excess will detract from the latent image formation. In other words, any light captured or absorbed by a spectral sensitizing dye molecule not on the silver halide grain cannot be used to convert a photon to an electron for latent image formation. Thus, it is preferred to saturate the silver halide with spectral sensitizing dye but not to have excess spectral sensitizing dye that would cause any to be present in the imaging layer other than on a silver halide crystal.

Thus, the preferred embodiment of the method involves separately spectrally sensitizing the silver halide and separately passivating the silver organic compound and only then mixing the two. It is also possible to separately passivate the silver organic compound, mixing with silver halide not spectrally sensitized and then adding spectral sensitizing dye to the mixture of passivated organic silver compound and silver halide. This is a possibility for specific silver halide emulsions where the chemical sensitization is done before spectral sensitization.

Thus, the present method involves forming an imaging layer in which the spectrally sensitized silver-halide emulsion has not been mixed with the bare organic silver compound (before it is passivated), which is equivalent to saying that the organic silver compound has been passivated before it is mixed with the silver-halide emulsion either spectrally sensitized or not.

As indicated above, a preferred embodiment of the invention relates to a dry photothermographic process employing blocked developers that decomposes (i.e., unblocks) on thermal activation to release a developing agent. In dry processing embodiments, thermal activation preferably occurs at temperatures between about 80 to 180° C., preferably 100 to 160° C.

By a "dry thermal process" or "dry photothermographic" process is meant herein a process involving, after imagewise exposure of the photographic element, developing the resulting latent image by the use of heat to raise the temperature of the photothermographic element or film to a temperature of at least about 80° C., preferably at least about 100° C., more preferably at about 120° C. to 180° C., without liquid processing of the film, preferably in an essentially dry process without the application of aqueous solutions. By an essentially dry process is meant a process that does not involve the uniform saturation of the film with a liquid, solvent, or aqueous solution. Thus, contrary to photothermographic processing involving low-volume liquid processing, the amount of water required is less than 1 times, preferably less than 0.4 times and more preferably less than 0.1 times the amount required for maximally swelling total coated layers of the film excluding a back layer. Most preferably, no liquid is required or applied to the film during thermal treatment. Preferably, no laminates are required to be intimately contacted with the film in the presence of aqueous solution.

Preferably, during thermal development an internally located blocked developing agent in reactive association with each of three light-sensitive units becomes unblocked to form a developing agent, whereby the unblocked developing agent is imagewise oxidized on development and this oxidized form reacts with the dye-providing couplers to form a dye and thereby a color image. While the formed image can be a positive working or negative working image, a negative working image is preferred.

The components of the photothermographic element can be in any location in the element that provides the desired image. If desired, one or more of the components can be in one or more layers of the element. For example, in some cases, it is desirable to include certain percentages of the reducing agent, toner, thermal solvent, stabilizer and/or other addenda in the overcoat layer over the photothermographic image recording layer of the element. This, in some cases, reduces migration of certain addenda in the layers of the element.

It is necessary that the components of the photographic combination be "in association" with each other in order to produce the desired image. The term "in association" herein means that in the photothermographic element the photographic silver halide and the image-forming combination are in a location with respect to each other that enables the desired processing and forms a useful image. This may include the location of components in different layers.

Preferably, development processing is carried out (i) for less than 60 seconds, (ii) at the temperature from 120 to 180° C., and (iii) without the application of any aqueous solution.

Dry thermal development of a color photothermographic film for general use with respect to consumer cameras provides significant advantages in processing ease and convenience, since they are developed by the application of heat without wet processing solutions. Such film is especially amenable to development at kiosks, with the use of essentially dry equipment. Thus, it is envisioned that a consumer could bring an imagewise exposed photothermographic film, for development and printing, to a kiosk located at any one of a number of diverse locations, optionally independent from a wet-development lab, where the film could be developed and printed without requiring manipulation by third-party technicians. It is also envisioned that a consumer could own and operate such film development equipment at home, particularly since the system is dry and does not involve the application and use of complex or hazardous chemicals. Thus, the dry photothermographic system opens up new opportunities for greater convenience, accessibility, and speed of development (from the point of image capture by the consumer to the point of prints in the consumer's hands), even essentially "immediate" development in the home for a wide cross-section of consumers.

By kiosk is meant an automated free-standing machine, self-contained and (in exchange for certain payments or credits) capable of developing a roll of imagewise exposed film on a roll-by-roll basis, without requiring the intervention of technicians or other third-party persons such as necessary in wet-chemical laboratories. Typically, the customer will initiate and control the carrying out of film processing and optional printing by means of a computer interface. Such kiosks typically will be less than 6 cubic meters in dimension, preferably about 3 cubic meters or less in dimension, and hence commercially transportable to diverse locations. Such kiosks may optionally comprise a heater for color development, a scanner for digitally recording the color image, and a device for transferring the color image to a display element.

Assuming the availability and accessibility of such kiosks, such photothermographic films could potentially be developed at any time of day, "on demand," in a matter minutes, without requiring the participation of third-party processors, multiple-tank equipment and the like. Such photothermographic processing could potentially be done on an "as needed" basis, even one roll at a time, without necessitating the high-volume processing that would justify, in a commercial setting, equipment capable of high-throughput. The kiosks thus envisioned would be capable of heating the film to develop a negative color image and then subsequently scanning the film on an individual consumer basis, with the option of generating a display element corresponding to the developed color image. Details of useful scanning and image manipulation schemes are disclosed in co-filed and commonly assigned U.S. Ser. Nos. 09/592,836 and 09/592,816, both hereby incorporated by reference in their entirety.

In view of advances in the art of scanning technologies, it has now become natural and practical for photothermographic color films such as disclosed in EP 0762 201 to be scanned, which can be accomplished without the necessity of removing the silver or silver-halide from the negative, although special arrangements for such scanning can be made to improve its quality. See, for example, Simmons U.S. Pat. No. 5,391,443. Method for the scanning of such films are also disclosed in commonly assigned U.S. Ser. Nos. 09/855,046 and 09/855,051, hereby incorporated by reference in their entirety.

Once distinguishable color records have been formed in the processed photographic elements, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. If other colors are imagewise present in the element, then appropriately colored light beams are employed. A simple technique is to scan the photographic element point-by-point along a series of laterally offset parallel scan paths. A sensor that converts radiation received into an electrical signal notes the intensity of light passing through the element at a scanning point. Most generally this electronic signal is further manipulated to form a useful electronic record of the image. For example, the electrical signal can be passed through an analog-to-digital converter and sent to a digital computer together with location information required for pixel (point) location within the image. The number of pixels collected in this manner can be varied as dictated by the desired image quality. Very low resolution images can have pixel counts of 192×128 pixels per film frame, low resolution 384×256 pixels per frame, medium resolution 768×512 pixels per frame, high resolution 1536×1024 pixels per frame and very high resolution 3072×2048 pixels per frame or even 6144×4096 pixels per frame or even more. Higher pixel counts or higher resolution translates into higher quality images because it enables higher sharpness and the ability to distinguish finer details especially at higher magnifications at viewing. These pixel counts relate to image frames having an aspect ratio of 1.5 to 1. Other pixel counts and frame aspect ratios can be employed as known in the art. Most generally, a difference of four times between the number of pixels rendered per frame can lead to a noticeable difference in picture quality, while differences of sixteen times or sixty four times are even more preferred in situations where a low quality image is to be presented for approval or preview purposes but a higher quality image is desired for final delivery to a customer. On digitization, these scans can have a bit depth of between 6 bits per color per pixel and 16 bits per color per pixel or even more. The bit depth can preferably be between 8 bits and 12 bits per color per pixel. Larger bit depth translates into higher quality images because it enables superior tone and color quality.

The electronic signal can form an electronic record that is suitable to allow reconstruction of the image into viewable forms such as computer monitor displayed images, television images, optically, mechanically or digitally printed images and displays and so forth all as known in the art. The formed image can be stored or transmitted to enable further manipulation or viewing, such as in Ser. No. 09/592,816 titled AN IMAGE PROCESSING AND MANIPULATION SYSTEM to Richard P. Szajewski, Alan Sowinski and John Buhr.

The retained silver halide in photothermographically developed film, however, can scatter light, decrease sharpness and raise the overall density of the film, thus leading to impaired scanning. Further, retained silver halide can print-out to ambient/viewing/scanning light, render non-imagewise density, degrade signal-to noise of the original scene, and raise density even higher. Finally, the retained silver halide and organic silver compounds can remain in reactive association with the other film chemistry, making the film unsuitable as an archival media. Thus, an option is to remove or stabilize these silver sources to render the photothermographic film to an archival state. Furthermore, the silver coated in the photothermographic film (silver halide, silver donor, and metallic silver) is unnecessary to the dye image produced, and this silver is valuable and the desire is to recover it is high.

In black and white embodiments of the invention, retention of the metallic silver is required for maintaining the image. In other monochrome embodiments of the invention, the image is retained in dye, in which case the metallic silver is no longer required. Examples of black & white and monochrome photothermographic elements are described, for example, in commonly assigned U.S. Pat. No. 5,466,804 and U.S. Ser. No. 09/761,954, hereby incorporated by reference in their entirety.

Thus, it may be desirable to remove, in subsequent processing steps, one or more of the silver containing components of the film: the silver halide, one or more silver donors, the silver-containing thermal fog inhibitor if present, and/or the silver metal. The three main sources are the developed metallic silver, the silver halide, and the silver donor. Alternately, it may be desirable to stabilize the silver halide in the photothermographic film. Silver can be wholly or partially stabilized/removed based on the total quantity of silver and/or the source of silver in the film.

The removal of the silver halide and silver donor can be accomplished with a common fixing chemical as known in the photographic arts. Specific examples of useful chemicals include: thioethers, thioureas, thiols, thiones, thionamides, amines, quaternary amine salts, ureas, thiosulfates, thiocyanates, bisulfites, amine oxides, iminodiethanol-sulfur dioxide addition complexes, amphoteric amines, bis-sulfonylmethanes, and the carbocyclic and heterocyclic derivatives of these compounds. These chemicals have the ability to form a soluble complex with silver ion and transport the silver out of the film into a receiving vehicle. The receiving vehicle can be another coated layer (laminate) or a conventional liquid processing bath. Laminates useful for fixing films are disclosed in U.S. Ser. No. 09/878,853, hereby incorporated by reference in their entirety. Automated systems for applying a photochemical processing solution to a film via a laminate are disclosed in U.S. Ser. No. 09/593,097.

The stabilization of the silver halide and silver donor can also be accomplished with a common stabilization chemical. The previously mentioned silver salt removal compounds can be employed in this regard. Such chemicals have the ability to form a reactively stable and light-insensitive compound with silver ion. With stabilization, the silver is not necessarily removed from the film, although the fixing agent and stabilization agent could very well be a single chemical. The physical state of the stabilized silver is no longer in large (>50 nm) particles as it was for the silver halide and silver donor, so the stabilized state is also advantaged in that light scatter and overall density is lower, rendering the image more suitable for scanning.

The removal of the metallic silver is more difficult than removal of the silver halide and silver donor. In general, two reaction steps are involved. The first step is to bleach the metallic silver to silver ion. The second step may be identical to the removal/stabilization step(s) described for silver halide and silver donor above. Metallic silver is a stable state that does not compromise the archival stability of the photothermographic film. Therefore, if stabilization of the photothermographic film is favored over removal of silver, the bleach step can be skipped and the metallic silver left in the film. In cases where the metallic silver is removed, the bleach and fix steps can be done together (called a blix) or sequentially (bleach+fix).

The process could involve one or more of the scenarios or permutations of steps. The steps can be done one right after another or can be delayed with respect to time and location. For instance, heat development and scanning can be done in a remote kiosk, then bleaching and fixing accomplished several days later at a retail photofinishing lab. In one embodiment, multiple scanning of images is accomplished. For example, an initial scan may be done for soft display or a lower cost hard display of the image after heat processing, then a higher quality or a higher cost secondary scan after stabilization is accomplished for archiving and printing, optionally based on a selection from the initial display.

For illustrative purposes, a non-exhaustive list of photothermographic film processes involving a common dry heat development step are as follows:

1. heat development→scan→stabilize (for example, with a laminate)→scan→obtain returnable archival film.

2. heat development→fix bath→water wash→dry→scan→obtain returnable archival film.

3. heat development→scan→blix bath→dry→scan→recycle all or part of the silver in film.

4. heat development→bleach laminate→fix laminate→scan→(recycle all or part of the silver in film).

5. heat development→bleach→wash→fix→wash→dry→relatively slow, high quality scan.

Other schemes will be apparent to the skilled artisan.

Photographic elements designed to be processed thermally (involving dry physical development processes) and then scanned may be designed to achieve different responses than optically printed film elements. The dye image characteristic curve gamma is generally lower than in optically printed film elements, so as to achieve an exposure latitude of at least 2.7 log E, which is a minimum acceptable exposure latitude of a multicolor photographic element. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. For this reason, it is advantageous to control the gamma of the film to be scanned by emulsion design, laydown or coupler laydown to give two examples of useful methods, known in the art.

A typical color negative film construction useful in the practice of the invention is illustrated by the following element, SCN-1:

| ELEMENT SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly(ethyleneterephthalate) film, poly (ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure* I.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. Nos. 4,279,945, and 4,302,523.

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m.

Any convenient selection from among conventional radiation-sensitive silver halide emulsions can be incorporated within the layer units and used to provide the spectral absorptances of the invention. Most commonly high bromide emulsions containing a minor amount of iodide are employed, although high chloride emulsions can also be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thickness are less than 0.3 $\mu$m (most preferably less than 0.2 $\mu$m). Ultrathin tabular grain emulsions, those with mean tabular grain thickness of less than 0.07 $\mu$m, can be optionally used. The grains preferably form surface latent images so that they produce negative images when processed in a surface developer in color negative film forms of the invention.

Illustrations of conventional radiation-sensitive silver halide emulsions are provided by *Research Disclosure* I, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure* I, cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure* I, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure*, I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be less than 10 g/m$^2$ of silver. Silver quantities of less than 7 g/m$^2$ are preferred, and silver quantities of less than 5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.5 g of coated silver per m$^2$ of support surface area in the element is necessary to realize an exposure latitude of at least 2.7 log E while maintaining an adequately low graininess position for pictures intended to be enlarged.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure* I, cited above, X. Dye image formers and modifiers, B. Image-dye-forming couplers. The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention, especially in color embodiments of the invention, is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptances according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure* I, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by

*Research Disclosure* I, Section VIII. Absorbing and scattering materials, B. Absorbing materials. In elements of the instant invention, magenta colored filter materials are absent from IL2 and RU.

The antihalation layer unit AHU typically contains a processing solution removable or decolorizable light absorbing material, such as one or a combination of pigments and dyes. Suitable materials can be selected from among those disclosed in *Research Disclosure* I, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure* I, Section IX. Coating physical property modifying addenda. The SOC overlying the emulsion layers additionally preferably contains an ultraviolet absorber, such as illustrated by *Research Disclosure* I, Section VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. The invention can be suitably applied to conventional color negative construction as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

In embodiments involving color negative elements, each layer unit of the elements produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gamma's as low as 1.0 or even 0.6 are contemplated and exposure latitudes of up to about 5.0 log E or higher are feasible. Gammas of about 0.55 are preferred. Gammas of between about 0.4 and 0.5 are especially preferred.

Instead of employing dye-forming couplers in such embodiments, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure* I, Section X. Dye image formers and modifiers, A. Silver dye bleach.

It is also well known that pre-formed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure*, Vol. 151, November 1976, Item 15162.

It is also recognized that the dye image can be provided by compounds that are initially mobile, but are rendered immobile during imagewise development. Image transfer systems utilizing imaging dyes of this type have long been used in previously disclosed dye image transfer systems. These and other image transfer systems compatible with the practice of the invention are disclosed in *Research Disclosure*, Vol. 176, December 1978, Item 17643, XXIII. Image transfer systems.

A number of modifications of color negative elements have been suggested for accommodating scanning, as illustrated by *Research Disclosure* I, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image which, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

In color PTG embodiments, when conventional yellow, magenta, and cyan image dyes (or other color combinations) are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometry, pp. 840–848.

Elements having excellent light sensitivity are best employed in the practice of this invention. At least color elements should have a sensitivity of at least about ISO 50, preferably have a sensitivity of at least about ISO 100, and more preferably have a sensitivity of at least about ISO 200, most preferably ISO 400. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number pH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

Photographic elements of the present invention are preferably imagewise exposed using any of the known techniques, including those described in *Research Disclosure* I, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of.energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

Examples of blocked developers that can be used in photographic elements of the present invention include, but are not limited to, the blocked developing agents described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4,060,418, to Waxman and Mourning; and in U.S. Pat. No. 5,019,492. Particularly useful are those blocked developers described in U.S. application Ser. No. 09/476,234, filed Dec. 30, 1999, IMAGING ELEMENT CONTAINING A BLOCKED PHOTOGRAPICALLY USEFUL COMPOUND; U.S. application Ser. No. 09/475,691, filed Dec. 30, 1999, IMAGING ELEMENT CONTAINING A BLOCKED PHOTOGRAPHICALLY USEFUL COMPOUND; U.S. application Ser. No. 09/475,703, filed Dec. 30, 1999, IMAGING ELEMENT CONTAINING A BLOCKED PHOTOGRAPHICALLY USEFUL COMPOUND; U.S. application Ser. No. 09/475,690, filed Dec. 30, 1999, IMAGING ELEMENT CONTAINING A BLOCKED PHOTOGRAPHICALLY USEFUL COMPOUND; and U.S. application Ser. No. 09/476,233, filed Dec. 30, 1999, PHOTOGRAPHIC OR photothemiographic ELEMENT CONTAINING A BLOCKED PHOTOGRAPHICALLY USEFUL COMPOUND. Further improvements in blocked developers are disclosed in U.S. Ser. Nos. 09/710,341, 09/718,014, 09/711,769, and 09/710,348. Yet other improvements in blocked developers and their use in photothermographic elements are found in commonly assigned copending applications, filed concurrently herewith, U.S. Ser. Nos. 09/718,027 and 09/717,742.

In one embodiment of the invention blocked developer for use in the present invention may be represented by the following Structure I:

$$\text{DEV—(LINK 1)}_l\text{—(TIME)}_m\text{—(LINK 2)}_n\text{—B} \qquad \text{I}$$

wherein,

DEV is a silver-halide color developing agent;

LINK 1 and LINK 2 are linking groups;

TIME is a timing group, l is 0 or 1;

m is 0, 1, or 2;

n is 0 or 1;

l+n is 1 or 2;

B is a blocking group or B is:

$$\text{—B'—(LINK 2)}_n\text{—(TIME)}_m\text{—(LINK 1)}_l\text{—DEV}$$

wherein B' also blocks a second developing agent DEV.

In a preferred embodiment of the invention, LINK 1 or LINK 2 are of Structure II:

II

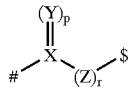

wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2);

$ denotes the bond to TIME (for LINK 1) or $T_{(t)}$ substituted carbon for LINK 2).

Illustrative linking groups include, for example,

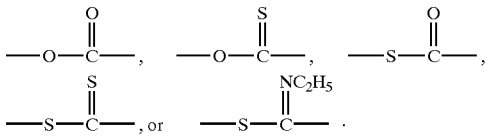

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Other blocked developers that can be used are, for example, those blocked developers disclosed in U.S. Pat. No. 6,303,282 B1 to Naruse et al., U.S. Pat. No. 4,021,240 to Cerquone et al., U.S. Pat. No. 5,746,269 to Ishikawa, U.S. Pat. No. 6,130,022 to Naruse, and U.S. Pat. No. 6,177,227 to Nakagawa, and substituted derivatives of these blocked developers. Although the present invention is not limited to any type of developing agent or blocked developing agent, the following are merely some examples of some photographically useful blocked developers that may be used in the invention to produce developers during heat development.

D-1
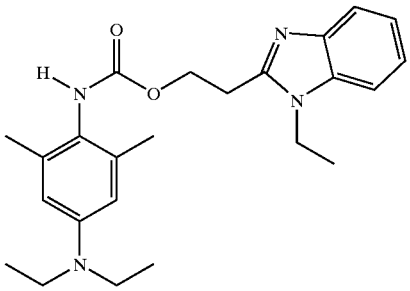
D-2
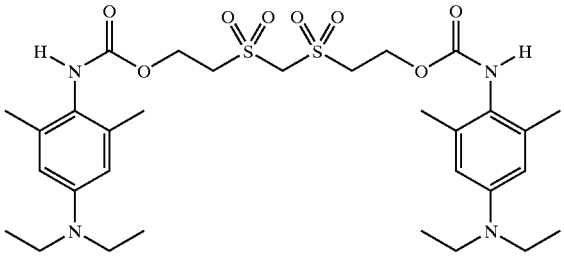
D-3
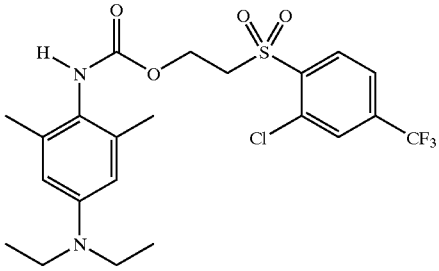
D-4
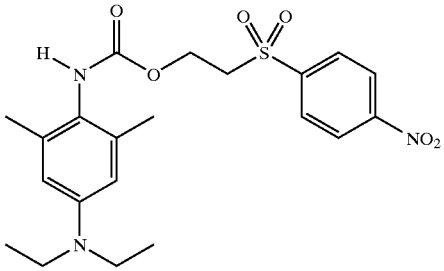
D-5
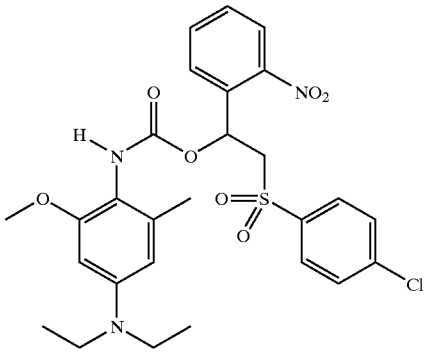
-continued
D-6
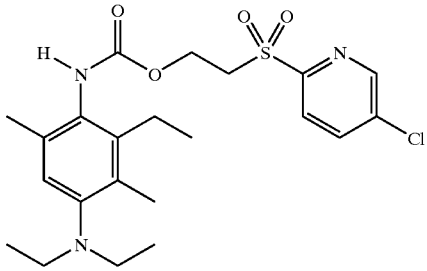
D-7
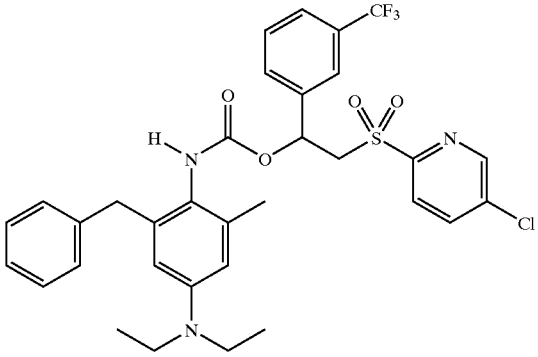
D-8
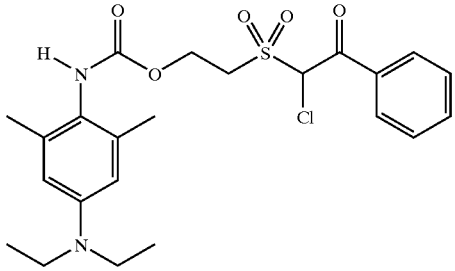
D-9
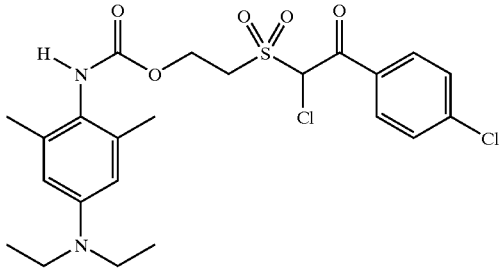
D-10
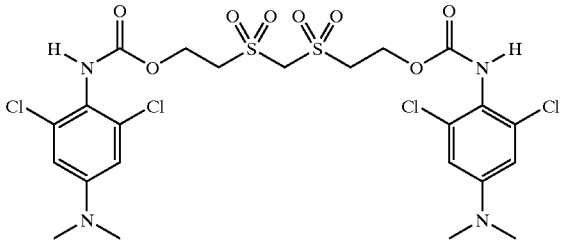

-continued

D-11

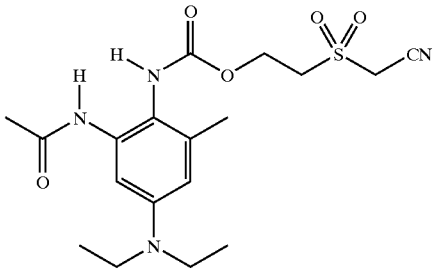

D-12

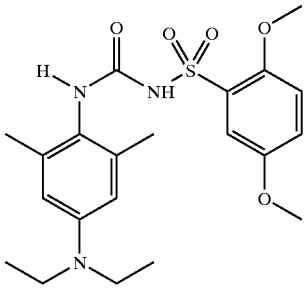

D-13

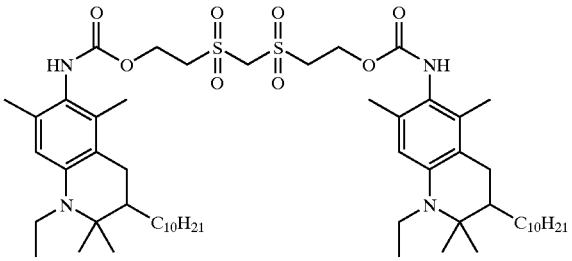

D-14

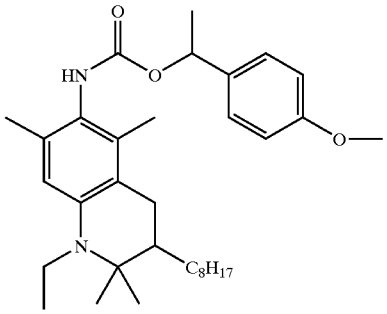

D-15

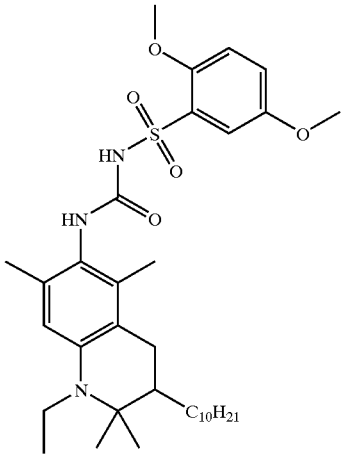

-continued

D-16

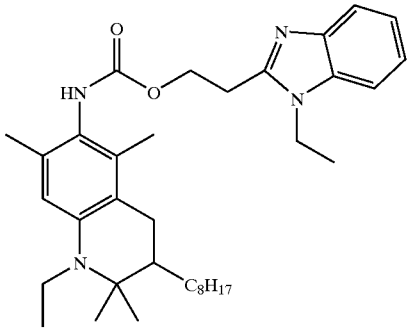

In the preferred embodiment, a blocked developer is incorporated in one or more of the imaging layers of the imaging element. The amount of blocked developer used is preferably 0.01 to 5 g/m$^2$, more preferably 0.1 to 2 g/m$^2$ and most preferably 0.3 to 2 g/m$^2$ in each layer to which it is added. These may be color forming or non-color forming layers of the element. The blocked developer can be contained in a separate element that is contacted to the photographic element during processing.

After image-wise exposure of the imaging element, the blocked developer is activated during processing of the imaging element by the presence of acid or base in the processing solution (no processing solution in this invention), by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure*, September 1996, Number 389, Item 38957 (hereafter referred to as ("*Research Disclosure I*"). All sections referred to herein are sections of *Research Disclosure I*, unless otherwise indicated. Such chemicals include, for example, sulfites, hydroxyl amine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

A reducing agent (for example nucleators or electron transfer agents) in addition to, or instead of, the blocked developer may be included in the photothermographic element. The reducing agent for the organic silver donor compound may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis (ethoxyethyl)hydroxylamine, piperidinohexose reductone or formyl-4-methylphenylhydrazine, hydroxamic acids such as phenylhydroxamic acid, p-hydroxyphenyl-hydroxamic acid, and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-β-naphthols as illustrated by 2,2'-dihydroxyl-1-binaphthyl, 6,6'-dibromo-2,2'-dihydroxy-1,1'-binaphthyl, and bis(2-hydroxy-1-naphthyl) methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bisphenols, e.g., bis(2-hydroxy-3-t-butyl-5-methylphenyl)-methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; pyrazolidin-3-ones; and certain indane-1,3-diones.

An optimum concentration of organic reducing agent in the photothermographic element varies depending upon such factors as the particular photothermographic element, desired image, processing conditions, the particular organic silver compound and the particular oxidizing agent.

The photothermographic element can comprise a thermal solvent. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Examples of toning agents and toning agent combinations are described in, for example, *Research Disclosure*, June 1978, Item No. 17029 and U.S. Pat. No. 4,123,282.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethylsulfonyl)benzothiazole; and 6-substituted-2,4-bis(tribromomethyl)-s-triazines, such as 6-methyl or 6-phenyl-2,4-bis(tribromomethyl)-s-triazine.

Imagewise exposure is preferably for a time and intensity sufficient to produce a developable latent image in the photothermographic element. After imagewise exposure of the photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed in commonly assigned, co-pending U.S. patent application Ser. Nos. 09/206,586, 09/206,612, and 09/206,583 filed Dec. 7, 1998, which are incorporated herein by reference. The use of an apparatus whereby the processor can be used to write information onto the element, information which can be used to adjust processing, scanning, and image display is also envisaged. This system is disclosed in U.S. patent application Ser. No. 09/206,914 filed Dec. 7, 1998 and Ser. No. 09/333,092 filed Jun. 15, 1999, which are incorporated herein by reference.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

In color imaging embodiments, once yellow, magenta, and cyan dye image records (or other color combinations) have been formed in the processed photographic elements of the invention, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, which employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management*, Addison-Wesley, 1998.

EXAMPLE 1

This example illustrates the preparation of organic silver compound SSB-1. A stirred reaction vessel was charged with 431 g of lime processed gelatin and 6569 g of distilled water. A solution containing 214 g of benzotriazole, 2150 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed.

A 4 l solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting organic silver compound dispersion contained fine particles of silver benzotriazole.

EXAMPLE 2

Organic silver compound SSP-1 was prepared as described in Example 1 above, except that an equimolar amount of 1-phenyl-5-mercaptotetrazole (PMT) was substituted for the benzotriazole to create Ag-PMT.

EXAMPLE 3

This example illustrates the preparation of organic silver compound SSB-2. One mol of SSB-1 was melted at 40° C. To this solution was added 8.0 mmol of cyanine dye PDY-1 and held for 90 minutes at 40° C. The dye was added from a suspension of dye crystals. The resulting passivated Ag-BZT was then chill-set.

| Compound | Structure |
|---|---|
| PDY-1 | 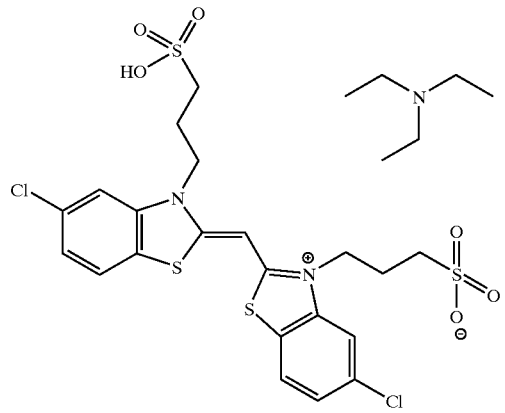 |

EXAMPLE 4

This example illustrates the preparation of organic silver compound SSP-2. One mol of SSP-1 was melted at 40° C. To this was added 8.0 mmol of cyanine dye PDY-1 and held for 90 minutes at 40° C. The dye was added from a suspension of dye crystals. The resulting passivated Ag-PMT was then chill-set.

EXAMPLE 5

This example illustrates the preparation of organic silver compound SSP-3 through SSP-10. One mol of SSP-1 was melted at 40° C. To this was added an amount of cyanine dye PDY-1 or PDUV-1 as specified in the table below, and held for 90 minutes at 40° C. The dyes were added from a suspension of dye crystals, except the UV dye was added from a gelatin dispersion. The resulting passivated Ag-PMT compounds were then chill-set.

| Compound | Structure |
|---|---|
| PDUV-1 | 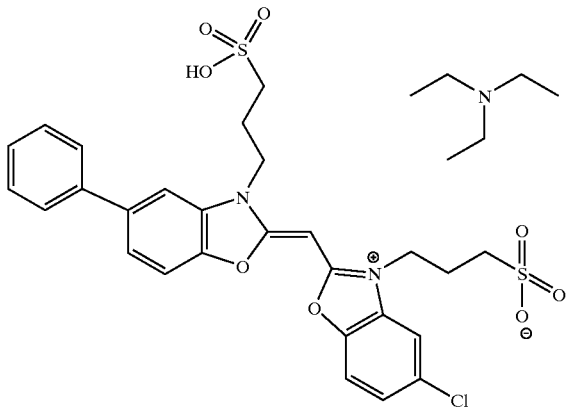 |

TABLE I

| Organic Silver Compound | Adsorbate | Amount added (mmol/mol SSP-1) |
|---|---|---|
| SSP-3 | PDY-1 | 5.0 |
| SSP-4 | PDY-1 | 10.0 |
| SSP-5 | PDY-1 | 20.0 |
| SSP-6 | PDUV-1 | 1.0 |
| SSP-7 | PDUV-1 | 5.0 |
| SSP-8 | PDUV-1 | 10.0 |
| SSP-9 | PDUV-1 | 15.0 |
| SSP-10 | PDUV-1 | 20.0 |

EXAMPLE 6

This example illustrates the preparation of organic silver compounds SSP-11 through SSP-14. One mol of SSP-1 was melted at 40° C. To this was added an amount of organic compound PDT-1 as specified in the table below, and held for 90 minutes at 40° C. The compound was added from an aqueous solution. The resulting passivated Ag-PMT compounds were then chill-set.

TABLE II

| Organic Silver Compound | Adsorbate | Amount added (mmol/mol SSP-1) |
|---|---|---|
| SSP-11 | PDT-1 | 11 7.3 |
| SSP-12 | PDT-1 | 14.6 |
| SSP-13 | PDT-1 | 29.3 |
| SSP-14 | PDT-1 | 73.1 |

| Compound | Structure |
|---|---|
| PDT-1 | 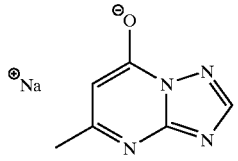 |

EXAMPLE 7

This example illustrates the method used to generate a comparison photographic element C-1-1. Inventive examples will follow this format except for variations to show the effectiveness of the invention. The following components were used in the samples, including a list of all of the chemical structures.

Blocked Developer BD-1

A dispersion of blocked developer BD-1 was prepared by ball milling with OLIN 10G surfactant.

Emulsion E-1

A silver halide tabular emulsion with a composition of 97% silver bromide and 3% silver iodide was prepared by conventional means. The resulting emulsion had an equivalent circular diameter of 1.2 microns and a thickness of 0.11 microns. This emulsion was spectrally sensitized to green light by addition of dyes SM-1 and SM-2, and then chemically sensitized with sulfur and gold for optimum performance.

Coupler Dispersion CDM-1

An oil-based coupler dispersion was prepared by conventional means containing coupler M-1 with tricresyl phosphate at a weight ratio of 1:0.5.

| Compound | Structure |
|---|---|
| BD-1 | 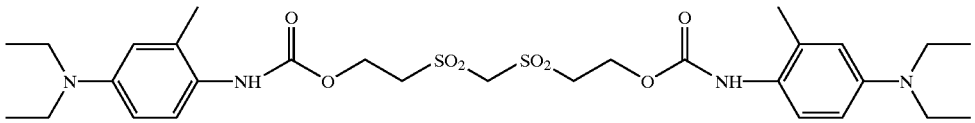 |
| M-1 | 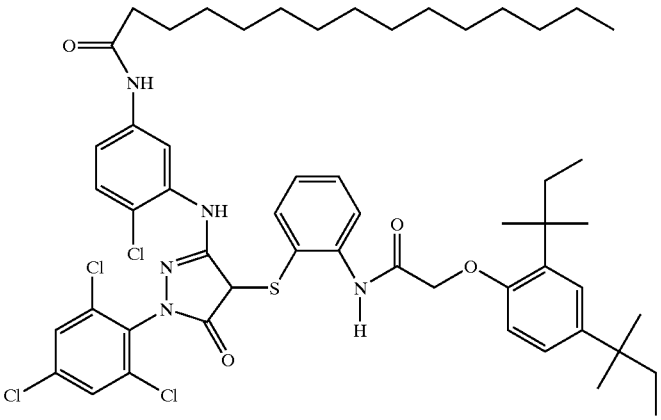 |

-continued

| Compound | Structure |
|---|---|
| SM-1 | 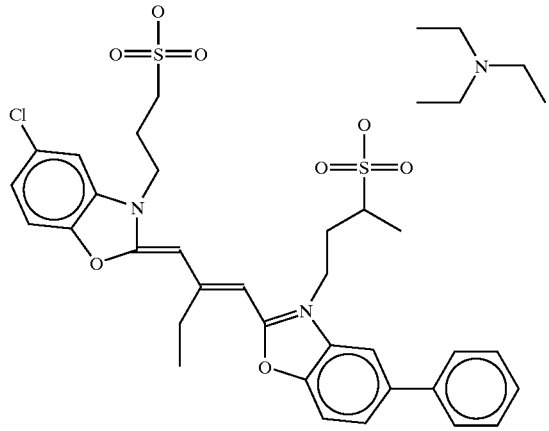 |
| SM-2 | 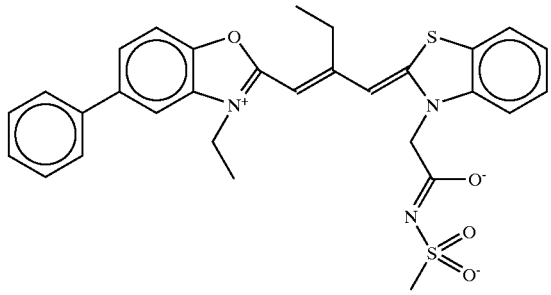 |

All coatings in this example were prepared according to the standard format listed in Table III below, with variations consisting of changing the organic silver compounds and the hold time of the organic silver compounds with the imaging emulsion. The emulsion E-1 and binder were mixed together in one vessel, while the coupler, developer, organic silver compounds, and salicylanilide were mixed in a separate vessel. Just prior to coating both mixtures were combined and spread onto the support. All coatings were prepared on a 7 mil thick poly(ethylene terephthalate) support.

TABLE III

| Component | Laydown |
|---|---|
| Silver (from emulsion E-1) | 0.86 $g/m^2$ |
| Silver (from organic silver compound SSB-1) | 0.32 $g/m^2$ |
| Silver (from organic silver compound SSP-1) | 0.32 $g/m^2$ |
| Coupler M-1 (from coupler dispersion CDM-1) | 0.54 $g/m^2$ |
| Developer (from BD-1 dispersion) | 0.86 $g/m^2$ |
| Salicylanilide | 0.86 $g/m^2$ |
| Lime processed gelatin | 4.31 $g/m^2$ |

The resulting coatings were exposed through a step wedge to a 3.04 log lux light source at 5500K filtered a Wratten 9 filter. The exposure time was 0.01 second. After exposure, the coating was thermally processed by contact with a 160° C. heated platen for 18 seconds. A number of strips were processed at a variety of platen temperatures in order to yield an optimum strip process condition. Photographic speeds were measured at developed density of 0.15 above Dmin. Results for the different silver salt variations are given in Table IV.

TABLE IV

| Coating | Organic Silver Compound 1 | Organic Silver Compound 2 | Speed (0.15 above Dmin) |
|---|---|---|---|
| C-1-1 (comparative) | SSP-1 | SSB-1 | 100 |
| I-1-1 (inventive) | SSP-2 | SSB-1 | 103 |
| I-1-2 (inventive) | SSP-2 | SSB-2 | 93 |
| I-1-3 (inventive) | SSP-1 | SSB-2 | 102 |

The above data show that the variations in passivation technique maintained the system performance when the organic silver compounds were added to the silver halide emulsion just prior to coating.

EXAMPLE 8

This example illustrates the performance of photographic elements according to the present invention. Inventive and comparative examples were prepared in a similar manner to coating C-1-1 with the exception that both organic silver compounds were mixed with emulsion E-1 prior to coating rather than being mixed with the coupler. Both emulsion and coupler mixtures were combined just prior to coating on 7 mil Estar support. The exposure and processing conditions were as described below with respect to each sample.

The resulting coatings were exposed through a step wedge to a 3.04 log lux light source at 5500K filtered by a Wratten 9 filter. The exposure time was 0.01 second. After exposure, the coating was thermally processed by contact with a 160° C. heated platen for 18 seconds. A number of strips were processed at a variety of platen temperatures in order to yield an optimum strip process condition. Photographic speeds were measured at developed density of 0.15 above Dmin. Results for the different silver salt variations are given in Table V.

TABLE V

| Coating | Organic Silver Compound 1 | Organic Silver Compound 2 | Speed (0.15 above Dmin) |
|---|---|---|---|
| C-2-1 (comparative) | SSP-1 | SSB-1 | 100 |
| I-2-1 (inventive) | SSP-2 | SSB-1 | 194 |
| I-2-2 (inventive) | SSP-2 | SSB-2 | 188 |
| I-2-3 (inventive) | SSP-1 | SSB-2 | 186 |

It can be seen from the results in Table V that the inventive organic silver compounds were effective in improving the spectral speed of the emulsion after mixing of the organic silver compounds with emulsion E1.

EXAMPLE 9

This example illustrates the performance of a compound according to the present invention in a photographic element that has been subjected to accelerated keeping. The photographic coatings were described in Examples 7 and 8. Before exposure the coating was held for 1 week in a sealed environment that had a relative humidity of 50% and a temperature of 120° F. A replicate sample was held for 1 week at 0° C. as a check. After one week both the incubated and refrigerated samples were exposed through a step wedge to a 3.04 log lux light source at 5500K filtered by a Wratten 9 filter. The exposure time was 0.01 second. After exposure, the coating was thermally processed by contact with a 160° C. heated platen for 18 seconds. Photographic speeds were measured at developed density of 0.15 above Dmin. Results for the various silver salts are given in Table VI.

TABLE VI

| Coating | Organic Silver Compound 1 | Organic Silver Compound 2 | Δ Speed, incubated-freezer |
|---|---|---|---|
| C-1-1 (comparative) | SSP-1 | SSB-1 | −55 |
| C-2-1 (comparative) | SSP-1 | SSB-1 | −118 |
| I-2-1 (inventive) | SSP-2 | SSB-1 | −40 |
| I-2-2 (inventive) | SSP-2 | SSB-2 | −42 |
| I-1-3 (inventive) | SSP-1 | SSB-2 | −35 |

It can be seen from Table VI that the inventive samples were better able to retain the photographic performance of the photographic element after incubation versus either of the comparative examples.

EXAMPLE 10

In this example, the photographic coatings described in Example 8 were subjected to wet processing in the C-41 process as described in the British Journal of Photography Annual for 1988, pages 196–198. The coatings were exposed through a step wedge to a 3.04 log lux light source at 5500K filtered by a Wratten 9 filter. The exposure time was 0.01 second. Results are given in Table VII.

TABLE VII

| Coating | Organic Silver Compound 1 | Organic Silver Compound 2 | Speed |
|---|---|---|---|
| C-2-1 (comparative) | SSP-1 | SSB-1 | 100 |
| I-2-1 (inventive) | SSP-2 | SSB-1 | 197 |
| I-2-2 (inventive) | SSP-2 | SSB-2 | 191 |
| I-2-3 (inventive) | SSP-1 | SSB-2 | 189 |

As seen from these results, the presence of a passivated donor was effective in typical wet processing conditions, retaining the photographic performance of the coatings.

EXAMPLE 11

In this example, photographic coatings were prepared in a manner similar to Example 8 with the exception that Organic Silver Compound 1 was varied while SSB-1 was maintained as Organic Silver Compound 2. The resulting coatings were exposed through a step wedge to a 3.04 log lux light source at 5500K filtered by a Wratten 9 filter. The exposure time was 0.01 second. After exposure, the coating was processed in the C-41 process. Photographic speeds were measured at developed density of 0.15 above Dmin. Results for the different organic silver compound variations are given in Table VIII.

TABLE VIII

| Coating | Organic Silver Compound 1 | Speed |
|---|---|---|
| C-3-1 (comparative) | SSP-1 | 100 |
| I-3-1 (inventive) | SSP-3 | 162 |
| I-3-2 (inventive) | SSP-4 | 159 |
| I-3-3 (inventive) | SSP-5 | 152 |

EXAMPLE 12

In this example, photographic coatings were prepared in a manner similar to Example 11 with the exception of the organic silver compounds used. The resulting coatings were exposed through a step wedge to a 3.04 log lux light source at 5500K filtered by a Wratten 9 filter. The exposure time was 0.01 second. After exposure, the coating was thermally processed by contact with a 160° C. heated platen for 18 seconds. Photographic speeds were measured at developed density of 0.15 above Dmin. Results for the different silver salt variations are given in Table IX.

TABLE IX

| Coating | Organic Silver Compound 1 | Speed |
|---|---|---|
| C-4-1 (comparative) | SSP-1 | 100 |
| I-4-1 (inventive) | SSP-6 | 114 |

TABLE IX-continued

| Coating | Organic Silver Compound 1 | Speed |
|---|---|---|
| I-4-2 (inventive) | SSP-7 | 158 |
| I-4-3 (inventive) | SSP-8 | 185 |

As can be seen in Table IX, the performance of the photographic system was improved for all levels of passivating agent used, with the optimum performance obtained for SSP-8.

EXAMPLE 13

In this example, photographic coatings were the same as in Example 12. The resulting coatings were exposed through a step wedge to a 3.04 log lux light source at 5500K filtered by a Wratten 9 filter. The exposure time was 0.01 second. After exposure, the coating was processed in the C-41 process. Photographic speeds were measured at developed density of 0.15 above Dmin. Results for the different silver salt variations are given in Table X.

TABLE X

| Coating | Organic Silver Compound 1 | Speed |
|---|---|---|
| C-4-1 (comparative) | SSP-1 | 100 |
| I-4-1 (inventive) | SSP-6 | 128 |
| I-4-2 (inventive) | SSP-7 | 169 |
| I-4-3 (inventive) | SSP-8 | 195 |

It is clear from the data in Table X that the optimum speed was obtained for the coating using organic silver compound SSP-8. All passivated samples demonstrated higher speed than the control.

EXAMPLE 14

In this example, photographic coatings were prepared in a manner similar to Example 11 with the exception of the organic silver compounds used. The resulting coatings were exposed through a step wedge to a 3.04 log lux light source at 5500K filtered by a Wratten 9 filter. The exposure time was 0.01 second. After exposure, the coating was thermally processed by contact with a 160° C. heated platen for 18 seconds. Photographic speeds were measured at developed density of 0.15 above Dmin. Results for the different organic silver compound variations are given in Table XI.

TABLE XI

| Coating | Organic Silver Compound I | Speed |
|---|---|---|
| C-5-1 (comparative) | SSP-1 | 100 |
| I-5-1 (inventive) | SSP-8 | 145 |
| I-5-2 (inventive) | SSP-9 | 153 |
| I-5-3 (inventive) | SSP-10 | 155 |

As can be seen in Table XI, the performance of the photographic system was also improved for higher levels of passivating agent.

EXAMPLE 15

In this example, photographic coatings were the same as in Example 14. The resulting coatings were exposed through a step wedge to a 3.04 log lux light source at 5500K filtered by a Wratten 2B filter. The exposure time was 0.01 second. After exposure, the coating was processed in the C-41 process. Photographic speeds were measured at developed density of 0.15 above Dmin. Results for the different organic silver compound variations are given in Table XII.

TABLE XII

| Coating | Organic Silver Compound 1 | Speed |
|---|---|---|
| C-5-1 (comparative) | SSP-1 | 100 |
| I-5-1 (inventive) | SSP-8 | 124 |
| I-5-2 (inventive) | SSP-9 | 132 |
| I-5-3 (inventive) | SSP-10 | 135 |

It is clear from the data in Table XII that the passivated donor samples demonstrated higher speed than the control.

EXAMPLE 16

This example demonstrates the invention using an organic passivation material that was not a dye. Photographic coatings were prepared in a manner similar to Example 11 with the exception of the organic silver compounds used. The resulting coatings were exposed through a step wedge to a 3.04 log lux light source at 5500K filtered by a Wratten 9 filter. The exposure time was 0.01 second. After exposure, the coating was thermally processed by contact with a 160° C. heated platen for 18 seconds. Photographic speeds were measured at developed density of 0.15 above Dmin. Results for the different organic silver compound variations are given in Table XIII.

TABLE XIII

| Coating | Organic Silver Compound 1 | Speed |
|---|---|---|
| C-6-1 (comparative) | SSP-1 | 100 |
| I-6-1 (inventive) | SSP-1 | 137 |
| I-6-2 (inventive) | SSP-12 | 134 |
| I-6-3 (inventive) | SSP-13 | 144 |
| I-6-4 (inventive) | SSP-14 | 155 |

EXAMPLE 17

In this example, photographic coatings were prepared in a manner similar to Example 11 with the following exceptions. The emulsion E-1 was replaced by emulsion E-2, which was a silver halide tabular emulsion with a composition of 97% silver bromide and 3% silver iodide and prepared by conventional means. The resulting emulsion had an equivalent circular diameter of 2.1 microns and a thickness of 0.13 microns. This emulsion was spectrally sensitized to red light by addition of dye SC-1 and SC-2, structures of which are shown below, and then chemically sensitized for optimum performance.

| Compound | Structure |
|---|---|
| SC-1 | 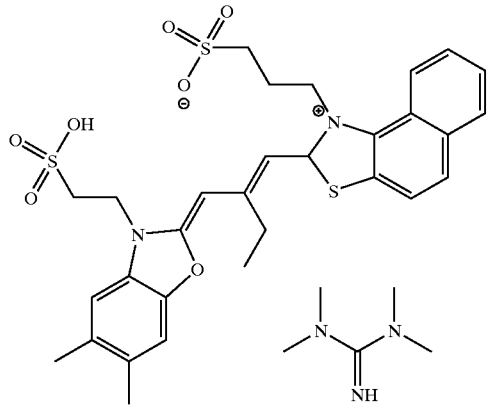 |
| SC-2 | 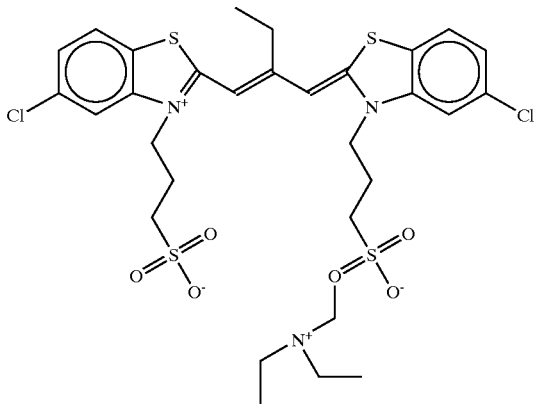 |

The organic silver compounds used in this example are given in Table XIV. The resulting coatings were exposed through a step wedge to a 3.04 log lux light source at 3000K filtered by Daylight 5A and Wratten 9 filters. The exposure time was 0.01 second. After exposure, the coating was processed through the C-41 process. Photographic speeds were measured at developed density of 0.15 above Dmin. Results for the different organic silver compound variations are given in Table XIV.

TABLE XIV

| Coating | Organic Silver Compound 1 | Speed |
|---|---|---|
| C-7-1 (comparative) | SSP-1 | 100 |
| I-7-1 (inventive) | SSP-9 | 141 |

As can be seen in Table XIV, the performance of the photographic system was improved for compositions suitable for a red color record.

EXAMPLE 18

A method is described to determine the level of passivating compound that has been added to the organic silver compound. Other methods to measure particle surface area relevant to this topic are, for example: a.) Herz, Danner, and Janusonis, *Adv. Chem. Ser. No.* 79, American Chemical Society, Washington, D.C., p. 173, 1968. b.) Herz and Helling, *J. Colloid and Interfacial Sci.*, vol. 22, p. 391, 1966. c.) Herz, *Adv. in Colloid and Intefacial Sci.*, vol. 8, p. 237, 1977. d.) Boyer and Cappelaere, *J. Chim. Phys.*, vol. 60, p. 1123, 1963. Organic silver compounds were prepared as shown in Examples 1 and 2 above. To each of the salts SSP-1 and SSB-2 was added a level series of passivating agent PDUV-1 as given in Table XV below. To determine the amount of passivating agent that was adsorbed to the organic silver compound, the passivated organic silver compound solution was analyzed by UV-Vis spectroscopy. It should be noted that when the passivating agent was adsorbed to the surface, the characteristic UV-Vis absorption spectra was red-shifted due to aggregation of the agent on the surface of the silver salt. The intensity of the absorption was used to determine the amount of passivating agent present, and the wavelength of the absorption was used to determine if the agent was aggregated on the surface of the organic silver compound. Hence, when there was agent present that was not adsorbed on the surface, an absorption peak occurred at shorter wavelengths than the adsorbed species. Confirmation of this was done by centrifuging the passivated compound and analyzing the supernatant for residual passivating agent. In order to prevent measuring convoluted peak intensities due to the overlap of the non-adsorbed and adsorbed agent, it is common practice to analyze the data based on the derivative of the absorption spectra, as described in Instrumental Methods of Analysis, 7th edition, Willard, Merritt, Dean, and Settle, Wadsworth Publishing, page 177ff. This provides a cleaner analysis of the amount of monomer present in the adsorbed passivating agent spectra. The absorption intensity in the accompanying table is the absolute value of the first derivative corresponding to the true absorption peak.

By performing the above tests on a series of added amounts of passivating agent, it was possible to develop an adsorption isotherm for the agent on the particular organic silver compound being studied. The results of the isotherm for dye PDUV-1, including the absorption wavelength for the dye without interaction with the donor, is given in Table XV.

TABLE XV

| Sample | Organic Silver Compound | Amount added (mmol/mol compound) | Absorption intensity @ 400 nm (aggregate peak) | Absorption intensity @ 389 nm (monomer peak) |
|---|---|---|---|---|
| C-8-1 (dye alone) | | 9e-3 μmol/ml* | <3.0e-5 | 1e-2 |
| C-8-2 (comparative) | SSP-1 | 0 | <3.0e-5 | <3.0e-5 |
| I-8-1 (inventive) | SSP-1 | 1 | 4.8e-4 | <3.0e-5 |
| I-8-2 (inventive) | SSP-1 | 5 | 1.1e-3 | <3.0e-5 |
| I-8-3 (inventive) | SSP-1 | 10 | 1.7e-3 | <3.0e-5 |
| I-8-4 (inventive) | SSP-1 | 30 | 3.7e-3 | 2.1e-4 |
| I-8-5 (inventive) | SSP-1 | 50 | 6.0e-3 | 3.2e-3 |

*The symbol e-n, where n is an integer, signifies $10^{-n}$.

This example shows that the level of passivating agent added to the organic silver compound can be determined through the use of adsorption isotherm data, providing information about the level of coverage achieved with the passivating agent while also yielding information about the level of non-adsorbed agent in the system. The above procedure can be used for any other passivating agent. Alternatively, once the coverage for one passivating agent has been determined, the coverage for other agents can be determined by utilizing the relative adsorbed molecular footprints, provided such information is available.

From the data in Table XV, it can be seen that saturation of the passivating agent occurs between 10 and 30 mmol/mol, because excess passivating agent appears in the test solution, as indicated by a monomer peak that is above the detection threshold of the instrument. By further sampling, it was determined that the saturation level is 25 mmol/mol for this donor. Thus, the "percent coverage" for sample I-8-2, is determined to be 100×(5 mmol/mol)/25 mmol/mol)=20 percent.

EXAMPLE 19

This example demonstrates the invention using organic passivation materials that were not dyes. Photographic coatings were prepared in a manner similar to Example 11 with the exception of the organic silver compounds used.

Organic silver compounds SSP-15 through SSP-26 were prepared by the same process as in the previous examples. One mol of SSP-1 was melted at 40° C. To this was added an amount of organic compound PDT-2 through PDT-8 as specified in the table below, and held for 90 minutes at 40° C. The compounds were added from an aqueous solution. The resulting passivated Ag-PMT compounds were then chill-set.

TABLE XVI

| Organic Silver Compound | Adsorbate | Amount added (mmol/mol SSP-1) |
|---|---|---|
| SSP-15 | PDT-2 | 15.0 |
| SSP-16 | PDT-2 | 75.0 |
| SSP-17 | PDT-3 | 15.0 |
| SSP-18 | PDT-3 | 75.0 |
| SSP-19 | PDT-4 | 15.0 |
| SSP-20 | PDT-4 | 75.0 |
| SSP-21 | PDT-5 | 15.0 |
| SSP-22 | PDT-6 | 15.0 |
| SSP-23 | PDT-7 | 15.0 |
| SSP-24 | PDT-7 | 75.0 |
| SSP-25 | PDT-8 | 15.0 |
| SSP-26 | PDT-8 | 75.0 |

The resulting coatings were exposed through a step wedge to a 3.04 log lux light source at 5500K filtered by a Wratten 9 filter. The exposure time was 0.01 second. After exposure, the coating was thermally processed by contact with a 160° C. heated platen for 18 seconds. Photographic speeds were measured at developed density of 0.15 above Dmin. Results for the different organic silver compound variations are given in Table XVII. All of the inventive examples displayed more photographic speed than the control.

TABLE XVII

| Coating | Organic Silver Compound 1 | Speed |
|---|---|---|
| C-9-1 (comparative) | SSP-1 | 100 |
| I-9-1 (inventive) | SSP-15 | 132 |
| I-9-2 (inventive) | SSP-16 | 122 |
| I-9-3 (inventive) | SSP-17 | 134 |
| I-9-4 (inventive) | SSP-18 | 134 |
| I-9-5 (inventive) | SSP-19 | 149 |
| I-9-6 (inventive) | SSP-20 | 153 |
| I-9-7 (inventive) | SSP-21 | 118 |
| I-9-8 (inventive) | SSP-22 | 110 |
| I-9-9 (inventive) | SSP-23 | 175 |
| I-9-10 (inventive) | SSP-24 | 179 |
| I-9-11 (inventive) | SSP-25 | 152 |
| I-9-12 (inventive) | SSP-26 | 130 |

| Compound | Structure |
|---|---|
| PDT-2 | 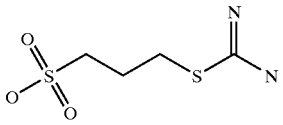 |

-continued

| Compound | Structure |
|---|---|
| PDT-3 | 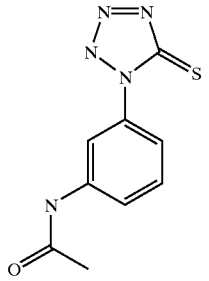 |
| PDT-4 | 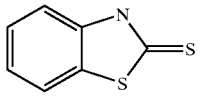 |
| PDT-5 | 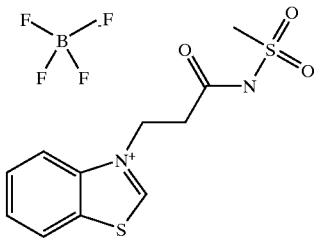 |
| PDT-6 | 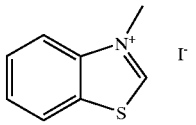 |
| PDT-7 | 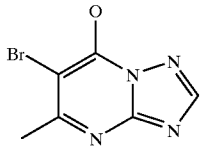 |
| PDT-8 | 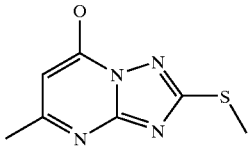 |

The invention has been described in detail with particular reference to certain preferred embodiments thereof, but it will be understood that variations and modifications can be effected within the spirit and scope of the invention.

What is claimed is:

1. A method of making a color photothermographic imaging element for accurately recording an image comprising a support and coated on the support a plurality of imaging layers each comprising a radiation sensitive silver-halide emulsion, wherein imaging layers are present that separately recording blue, green, and red exposures, and wherein at least one imaging layer is made by a procedure comprising:

(a.) mixing an emulsion of silver halide with a melt comprising a binder and a dispersion of particles of at least one organic silver compound to produce an imaging-layer composition, wherein prior to said mixing, the particles of organic silver compound has been coated with an effective amount of at least one dye for passivating the organic silver compound, wherein the dye is not a spectral sensitizing dye used on the silver halide in the imaging layer; and (b.) coating the imaging-layer composition onto a substrate for the photothermographic imaging element.

2. The method of claim 1 wherein the photothermographic imaging element is a color photothermographic element having on said support at least three light-sensitive color imaging layers which have their individual sensitivities in different wavelength regions, each of said imaging layers comprising a light-sensitive silver emulsion, a binder, a dye-providing coupler, and a developer or developer precursor, the dyes formed from the dye-providing couplers in the layers being different in hue, therefore capable of forming at least three dye images of different visible or non-visible colors, and wherein at least one of said imaging layers is made by said procedure.

3. The method of claim 1 or 2 wherein the silver halide has been spectrally sensitized prior to mixing.

4. The method of claim 3 wherein said dye and the spectral sensitizing dye on the silver halide are the same compound.

5. The method of claim 1 or 2 wherein said particles are treated with said dye in a total amount that provides, ex situ, an average coverage of at least 5 percent of the available surface area of said particles.

6. The method of claim 1 or 2, wherein said organic silver salt is not a silver carboxylate.

7. The method of claim 1 or 2, wherein said dye is used in an amount that provides ex situ an average coverage in an amount of 25 to 200 percent of the available surface area of the particles of the at least one organic silver compound.

8. The method of claim 1 or 2, wherein said imaging layer particles comprise two or more different organic silver compounds, either in the same or different particles.

9. The method of claim 1 or 2, wherein said dye is a yellow dye.

10. The method of claim 1 or 2 wherein said dye is a green dye or a red dye.

11. The method of claim 1 or 2, wherein said dye is a dye in the visible or non-visible spectrum.

12. The method of claim 1 or 2, wherein said dye is a passivating spectral sensitizing dye, meaning having the property of a spectral sensitizing dye if it were adsorbed on a silver halide crystal.

13. The method of claim 1 or 2 wherein the dye is not a spectral sensitizing dye.

14. The method of claim 1 or 2, wherein said dye in one imaging layer is a spectral sensitizing dye and said dye in another imaging layer is a UV dye.

15. The method of claim 1, wherein the dye in one or more imaging layers is a spectral sensitizing dye that does not absorb in the same wavelength region as the spectral sensitizing dye employed to treat the silver halide crystal used in that layer.

16. The method of claim 1, wherein the dye is an infrared or ultraviolet dye.

17. The method of claim 16, wherein the dye is different in at least two different imaging layers.

18. The method of claim 16, wherein the dye in one imaging layer is a UV filter dye and, in another imaging layer, instead of a dye, a tetraazaindene or a derivative thereof is used as a passivating agent.

19. The method of claim 1, wherein the particles comprise at least one organic silver compound present in the amount of at least 5 g/mol of the silver halide.

20. The method of claim 1 wherein the particles comprise at least one organic silver compound selected from the group consisting of silver salts or ligands of benzotriazoles, triazoles, and derivatives thereof.

21. A color photothermographic element comprising a red light-sensitive silver halide layer unit, a green light-sensitive silver halide layer unit, and a blue light-sensitive silver halide layer unit, each layer unit further comprising a light-sensitive silver halide, a developer or developer precursor, a binder, and one or more essentially non-light sensitive organic silver compounds, at least one of which functions as an oxidizing agent for the purpose of donating silver during dry thermal development, (a) wherein at least one imaging layer comprises particles of at least one organic silver compound which particles have been treated with at least one dye for passivating the organic silver compound, which dye is in a total amount that provides, ex situ, an average coverage of at least 5 percent of the available surface area of said particles, wherein the dye is not a spectral sensitizing dye used on the silver halide in the imaging layer, (b) wherein the actual average coverage of the available surface are of the particles with said dye, in the imaging layer, is more than would have occurred had the particles of the organic silver compound and the silver halide been mixed before treatment of the particles with the dye, wherein when the total amount used in (a) is more than needed for 100% coverage, then the coverage in parts (a) and (b) may also be equal.

22. The color photothermographic element of claim 21, wherein the organic silver salt being treated is not a silver carboxylate compound.

23. The color photothermographic element of claim 21, wherein the dye is essentially absent from the surface of the silver halide in the imaging element.

24. The color photothermographic element of claim 21, wherein all the imaging layers comprise particles of at least one organic silver compound that have been treated with one or more dyes.

25. The color photothermographic element of claim 21, wherein the dye is used in an amount that provides ex situ an average coverage in an amount of 25 to 200 percent of the available surface area of the particles of the at least one organic silver compound.

26. The color photothermographic element of claim 21, wherein the imaging layer comprises one or two different organic silver compounds.

27. The color photothermographic element of claim 21, wherein the ratio of dye passivating-agent actual average coverage, in the imaging layer, to available surface area for the particles of organic silver compound, compared to the same ratio had the particles of the organic silver compound and the silver halide been mixed, prior to treatment of the particles of the organic silver compound with the dye, is greater than 1.5.

28. The color photothermographic element of claim 21, wherein at least one imaging layer comprises an organic silver compound on which one or more dyes provide, in the imaging layer, an actual average coverage of at least 5% of the available surface area of the particles of the organic silver compound, and the dye is substantially absent from, or provides an average coverage of less than 5% of the available surface area of, the silver halide in the imaging element.

29. The color photothermographic element of claim 21, wherein at least one imaging layer comprises an organic silver compound on which one or more dyes provide, in the imaging layer, an actual average coverage of at least 10% of the available surface area of the particles of the organic silver compound, and the dye is substantially absent from, or provides an average coverage of less than 10% of the available surface area of, the silver halide in the imaging layer.

30. The color photothermographic element of claim 21, wherein all the imaging layers comprise an organic silver compound on which one or more dyes provide, in the imaging layer, an actual average coverage of at least 10% of the available surface area of the particles of the organic silver compound.

31. The color photothermographic element of claim 21, wherein the dye is a compound comprising a functional group comprising a nitrogen or sulfur atom which functional group enhances the ability of the dye passivating agent to exhibit adsorption to metallic silver and salts or ligands thereof.

32. The color photothermographic element of claim 21, wherein the dye is a dye in the visible or non-visible spectrum.

33. The color photothermographic element of claim 21, wherein the dye is a passivating spectral sensitizing dye, meaning having the property of a spectral sensitizing dye if it were adsorbed on a silver halide crystal.

34. The color photothermographic element of claim 21 wherein the dye is not a spectral sensitizing dye.

35. The color photothermographic element of claim 21, wherein the dye in one imaging layer is a spectral sensitizing dye and the dye in another imaging layer is a UV dye.

36. The color photothermographic element of claim 21, wherein the dye in one or more imaging layers is a spectral sensitizing dye that does not absorb in the same wavelength region as the spectral sensitizing dye employed to treat the silver halide crystal used in that layer.

37. The color photothermographic element of claim 21, wherein the dye is an infrared or ultraviolet dye.

38. The color photothermographic element of claim 21, wherein there are a plurality of imaging layers with passivated organic silver compounds and the dye is different in at least two different imaging layers.

39. The color photothermographic element of claim 21, wherein the dye in one imaging layer is a UV filter dye and the passivating agent in another imaging layer is tetraazaindene or a derivative thereof.

40. The color photothermographic element of claim 21, wherein the at least one organic silver compound is present in the amount of at least 5 g/mol of the silver halide, and is selected from the group consisting of silver salts or ligands of benzotriazoles, triazoles, and derviatives thereof.

41. The color photothermographic element of claim 40 wherein, in addition to a first organic silver compound functioning as a silver donor, a second organic silver compound is present that comprises a mercapto-functional compound at levels in the range of 5 to 3,000 g/mol of silver halide.

42. A color photothermographic element comprising a red light-sensitive silver halide layer unit, a green light-sensitive silver halide layer unit, and a blue light-sensitive silver halide layer unit, each layer unit further comprising a light-sensitive silver halide, a developer or developer precursor, a binder, and one or more essentially non-light sensitive organic silver compounds, at least one of which functions as an oxidizing agent for the purpose of donating silver during dry thermal development, (a) wherein at least one imaging layer comprises particles of at least one organic silver compound which particles have been treated with at least one dye for passivating agent for the organic silver compound, which dye absorbs in the non-visible region of the spectrum, either an IR or UV dye, in a total amount that provides, ex situ, an average coverage of at least 5 percent of the available surface area of said particles, wherein the dye is not a spectral sensitizing dye used on the silver halide in the imaging layer, (b) wherein the actual average coverage of the available surface are of the particles with said dye, in the imaging layer, is more than would have occurred had the particles of the organic silver compound and the silver halide been mixed before treatment of the particles with the dye, wherein when the total amount used in (a) is more than needed for 100% coverage, then the coverage in parts (a) and (b) may also be equal.

43. A color photothermographic element comprising a red light-sensitive silver halide layer unit, a green light-sensitive silver halide layer unit, and a blue light-sensitive silver halide layer unit, each layer unit further comprising a light-sensitive silver halide, a developer or developer precursor, a binder, and one or more essentially non-light sensitive organic silver compounds, at least one of which functions as an oxidizing agent for the purpose of donating silver during dry thermal development, (a) wherein at least one imaging layer comprises particles of at least one organic silver compound which particles have been treated with at least one dye that absorbs in the visible region of the spectrum, in a total amount that provides, ex situ, an average coverage of at least 5 percent of the available surface area of said particles, wherein the dye is not a spectral sensitizing dye used on the silver halide in the imaging layer, (b) wherein the actual average coverage of the available surface are of the particles with said dye, in the imaging layer, is more than would have occurred had the particles of the organic silver compound and the silver halide been mixed before treatment of the particles with the dye, wherein when the total amount used in (a) is more than needed for 100% coverage, then the coverage in parts (a) and (b) may also be equal.

44. A color photothermographic element comprising a red light-sensitive silver halide layer unit, a green light-sensitive silver halide layer unit, and a blue light-sensitive silver halide layer unit, each layer unit further comprising a light-sensitive silver halide, a developer or developer precursor, a binder, and one or more essentially non-light sensitive organic silver compounds, at least one of which functions as an oxidizing agent for the purpose of donating silver during dry thermal development, (a) wherein at least one imaging layer comprises particles of at least one organic silver compound which particles have been treated with at least one dye for passivating the organic silver compound, which dye absorbs in the visible region of the spectrum, in a total amount that provides, ex situ, an average coverage of at least 5% of the available surface area of said particles of the organic silver compound, and (b) wherein a second imaging layer comprises particles of at least one organic silver compound which particles have been treated with at least one dye that absorbs in the non-visible region of the spectrum, either an IR or UV dye, in a total amount that provides, ex situ, an average coverage of at least 5% of the available surface area of the particles of the organic silver compound, (c) wherein the actual average coverage of the available surface are of the particles with said dye, in both imaging layers, is more than would have occurred had the particles of the organic silver compound and the silver halide been mixed before treatment of the particles with the dye, wherein when the total amount used in (a) is more than needed for 100% coverage, then the coverage in parts (a) and (b) may also be equal.

* * * * *